US006339299B1

(12) United States Patent
Wu et al.

(10) Patent No.: US 6,339,299 B1
(45) Date of Patent: Jan. 15, 2002

(54) PREHEATING CIRCUIT FOR DETECTING THE FILAMENT TEMPERATURE OF FLUORESCENT LAMPS

(75) Inventors: Tsai-Fu Wu, Chiai; Yong-Jing Wu, Kaoshsiung, both of (TW)

(73) Assignee: National Science Council (TW)

( * ) Notice: Subject to any disclaimer, the term of this patent is extended or adjusted under 35 U.S.C. 154(b) by 0 days.

(21) Appl. No.: 09/684,281

(22) Filed: Mar. 20, 2001

(30) Foreign Application Priority Data

Jul. 31, 2000 (TW) ..... 89213252

(51) Int. Cl.[7] ..... H05B 37/00

(52) U.S. Cl. ..... 315/244; 315/94; 315/105; 315/224; 315/291; 315/DIG. 4; 315/DIG. 5

(58) Field of Search ..... 315/94, 97, 105, 315/209 R, 209 CD, 224, 225, 244, 291, 241 R, DIG. 4, DIG. 5, DIG. 7

(56) References Cited

U.S. PATENT DOCUMENTS 4,920,299 A * 4/1990 Presz et al. ..... 315/98
5,063,490 A * 11/1991 Maehara et al. ..... 315/105 X
5,363,020 A * 11/1994 Chen et al. ..... 315/209 R
5,920,155 A 6/1999 Kanda et al. ..... 315/307
6,246,181 B1 * 6/2001 Naruo et al. ..... 315/209 R

* cited by examiner

*Primary Examiner*—Haissa Philogene
(74) *Attorney, Agent, or Firm*—Skjerven Morrill MacPherson LLP; Norman R. Klivans

(57) ABSTRACT

A preheating circuit for a fluorescent lamp is provided. The preheating circuit includes a filament detecting circuit indirectly detecting a filament resistance in a fluorescent lamp by measuring a filament voltage and a filament current, a pulse generation circuit providing pulses of one of a first frequency and a second frequency determined by the detected filament resistance and a specific filament resistance, and a filament resonance circuit operating the fluorescent lamp at an operating frequency determined by the pulse generation circuit. Therefore, the filament resonance circuit operates at the first frequency to preheat the fluorescent lamp when the detected filament resistance is smaller than the specific resistance. The filament resonance circuit operates at the second frequency to operate the fluorescent lamp when the detected filament resistance is one of a first value being larger than and a second value being equal to that of the specific resistance.

12 Claims, 5 Drawing Sheets

PREHEATING CIRCUIT FOR DETECTING THE FILAMENT TEMPERATURE OF FLUORESCENT LAMPS

FIELD OF THE INVENTION

The present in vent ion relates to a preheating circuit for detecting the filament temperature of fluorescent lamps, and more particularly to a circuit indirectly detecting a filament temperature to ensure that filaments operate at a thermionic emission temperature.

BACKGROUND OF THE INVENTION

Properly preheating filaments becomes considerably necessary to avoid deteriorating the lamp life. Igniting a lamp at a low filament temperature requires a relatively high ignition voltage, causing bombardment and resulting in extremely sputtering on filaments. On the other hand, overheating the filaments will cause their coating material over evaporating and thermal shock. Both of the two improper preheating conditions engender sputtering and shorting the life of the lamp. Lamp filaments must reach their emission temperature at starting stage to minimize electrode sputtering. The preheating ratio ($\gamma=R_h/R_c$) of the hot resistance ($R_h$) of the electrodes to their cold resistance ($R_c$) is an index in knowing a n approximate emission temperature, and the electrodes with such a ratio means that it reaches a temperature high enough for thermionic emission.

FIGS. 1(*a*)~(*c*) show three typical preheating circuits for fluorescent lamps. Please refer to FIG. 1(*a*). The preheating circuit is implemented by using the characteristic that the resistance of the positive temperature coefficient (PTC) of the resistor $R_1$ is increased with increasing temperature to preheat the filaments. When the resistance of the resistor $R_1$ is low at a low temperature, most of the preheating current flows through the capacitor $C_1$ and the resistor $R_1$. At this time, the circuit operates at a preheating frequency to preheat the filaments. When the resistance of the resistor $R_1$ increases with the increasing temperature, more current flows from the capacitor $C_1$ to the capacitor $C_2$. The disadvantage of the preheating circuit is that the filaments are hard to operate at a thermionic emission temperature because the preheating time depends on the variation of the positive temperature coefficient resistance.

Referring to FIG. 1(*b*), the resistors $R_3$ and $R_4$ in series form a voltage divider. The voltage $V_1$ in the voltage divider turns on the switching element $Q_2$ and the switching element $Q_2$ is in parallel with the capacitor $C_4$. Therefore, the voltage across the lamp is low. When the current flows through the resistor $R_2$ to charge the capacitor $C_3$ until the capacitor voltage of the capacitor $C_3$ reaches the breakdown voltage of the diode $D_1$, the switching element $Q_1$ is turned on and the switching element $Q_2$ is forced to be turned off. The capacitance of the capacitor $C_3$ is adjusted to determine the charging time of the capacitor $C_3$ to control the preheating time so as to let the filament temperature is high enough. Therefore the preheating time is determined by the amount of the charges on the capacitor $C_3$. If the initial voltage of the capacitor $C_3$ is high, the charging time for reaching the breakdown voltage of the diode $D_1$ is shorter. On the other hand, the initial voltage of the capacitor $C_3$ is zero, the charging time for reaching the breakdown voltage of the diode $D_1$ is the longest. Therefore, the phenomenon of overheating the filaments or igniting a lamp at a low filament temperature also exists because the preheating time depends on the amount of the charges on the capacitor $C_3$ but does not depend on the filament temperature.

As shown in FIG. 1(*c*), the charging time of the RC circuit is used to control the preheating time. When the voltage of the capacitor $C_5$ is not charged to the breakdown voltage of the diode $D_2$, the circuit operates in higher frequency and the lamp voltage is not high enough to ignite the lamp. And the resonant current is used to preheat the filament. The drawback is same as described in FIG. 1(*b*). The phenomenon of overheating the filaments or igniting a lamp at a low filament temperature also exists because the preheating time depends on the amount of the charges on the capacitor $C_5$ but does not depend on the filament temperature.

Otherwise, U.S. Pat. No. 5,920,155 discloses an electronic ballast for discharge lamps which sets a filament current and a voltage across a discharge lamp at their suitable operational levels according to respective operational states of the discharge lamps, and which also provides a sufficient dimming function even when the lamp is of a slim type. However, it is not mentioned how to dynamically adjust the preheating time. Therefore, the filaments are not sure to operate at a thermionic emission temperature. Thus, the preheating circuit needs to be improved to overcome the above problem.

SUMMARY OF THE INVENTION

It is therefore an object of the present invention to propose a preheating circuit for a fluorescent lamp. The preheating circuit includes a filament detecting circuit for indirectly detecting a filament resistance in a fluorescent lamp by measuring a filament voltage and a filament current, a pulse generation circuit for providing pulses of one of a first frequency and a second frequency determined by the detected filament resistance and a specific filament resistance, and a filament resonance circuit operating the fluorescent lamp at an operating frequency determined by the pulse generation circuit so that the filament resonance circuit operates at the first frequency to preheat the fluorescent lamp when the detected filament resistance is smaller than the specific resistance and the filament resonance circuit operates at the second frequency to operate the fluorescent lamp when the detected filament resistance is one of a first value being larger than and a second value being equal to that of the specific resistance.

According to an aspect of the present invention, the first frequency is a preheating frequency $\omega_{s(ph)}$.

Preferably, the second frequency is a switching frequency $\omega_{s(ft)}$ at full load.

Preferably, the specific resistance is a hot filament resistance $R_h$ which is an index to preheat the fluorescent lamp when the detected filament resistance $R_f$ is smaller than the hot filament resistance $R_h$.

Preferably, the hot filament resistance $R_h$ is $\gamma$ times a cold filament resistance $R_C$ where $\gamma$ is a preheating ratio and $\gamma>1$.

Preferably, the filament detecting circuit includes a first series circuit of a secondary winding of a transformer and a first diode electrically connected in parallel to a first smoothing capacitor and a first resistor for generating a first DC output voltage, a second series circuit of a filament resistor and a second diode connected in parallel to a second smoothing capacitor and a second resistor for generating a second DC output voltage, and a comparator having an inverting input electrically connected in parallel to the first smoothing capacitor, and a noninverting input electrically connected in parallel to the second smoothing capacitor for providing a switching signal to the pulse generation circuit for generating the operating frequency.

Preferably, the first DC output voltage is in proportion to a secondary voltage $V'_{Lr}$ of the secondary winding of the transformer and the second DC output voltage is in proportion to a filament voltage $V_{R_f}$ across the filament resistor.

Preferably, the secondary voltage $V'_{Lr}$ equals to $\gamma R_c * V_{Lr}/\omega_{s(ph)}L_r$ where $V_{Lr}$ is a primary voltage of the primary winding of the transformer, and $L_r$ is an inductance of the primary winding of the transformer.

Preferably, the filament voltage $V_{Rf}$ equals to $R_f * V_{Lr}/\omega_{s(Ph)}L_r$.

Preferably, the filament resonance circuit operates at the preheating frequency $\omega_{s(ph)}$ to preheat the fluorescent lamp when the detected filament resistance $R_f$ is smaller than the hot filament resistance $R_h$ while the filament resonance circuit operates at the switching frequency $\omega^{s(ft)}$ to operate the fluorescent lamp when the detected filament resistance $R_f$ is one of a first value being larger than and a second value being equal to that of the hot filament resistance $R_h$.

Preferably, the filament resonance circuit operates at the preheating frequency $\omega_{s(ph)}$ to preheat the fluorescent lamp when the filament voltage $V_{R_f}$ is smaller than the secondary voltage $V'_{Lr}$ while the filament resonance circuit operates at the switching frequency $\omega_{s(ft)}$ to operate the fluorescent lamp when the filament voltage $V_{R_f}$ is one of a first value being larger than and a second value being equal to that of the secondary voltage $V'_{Lr}$.

The present invention may best be understood through the following description with reference to the accompanying drawings, in which:

DESCRIPTION OF THE PREFERRED EMBODIMENTS

Figure 1A:
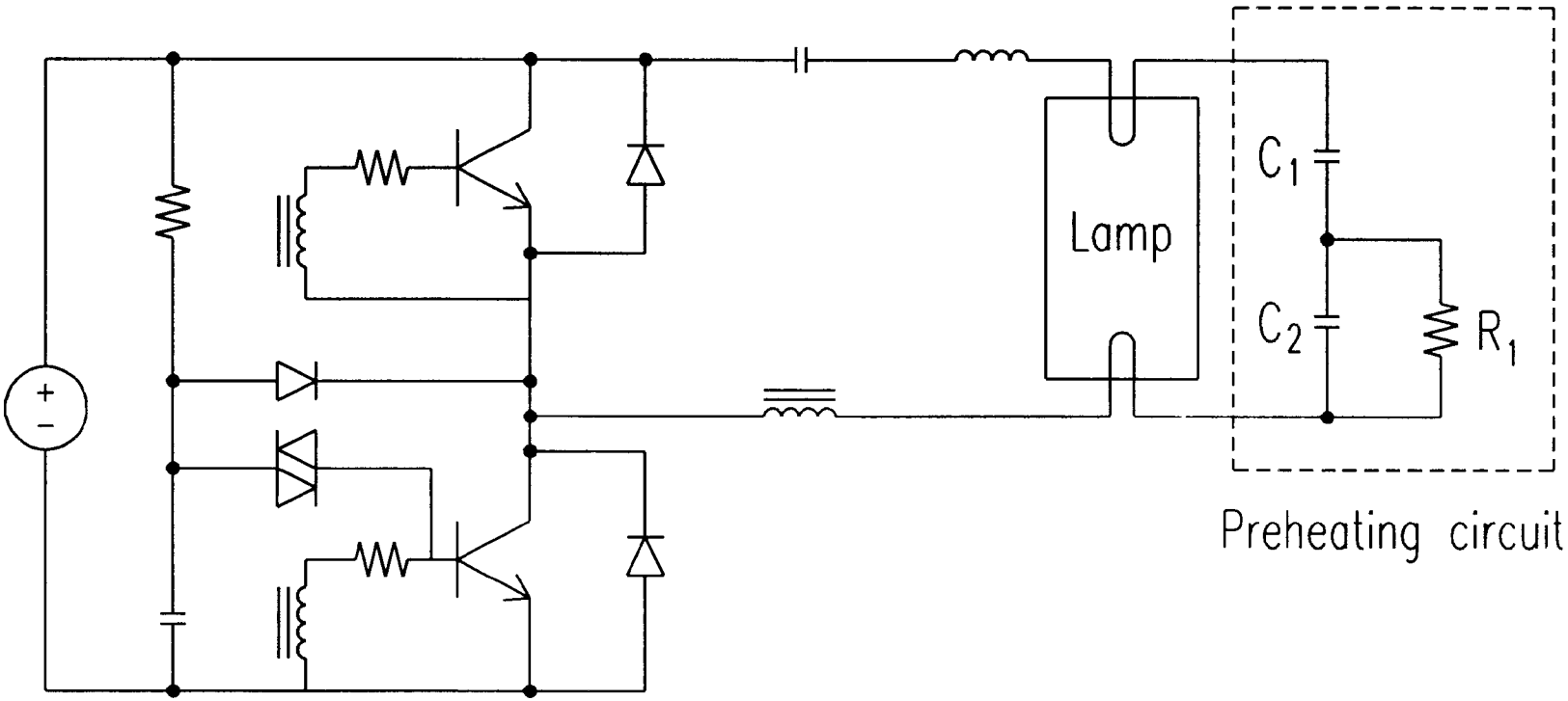
Fig. 1(a)(PRIOR ART)
FIGS. 1(*a*)~(*c*) illustrate three preheating circuits according to prior art.
Figure 1B:
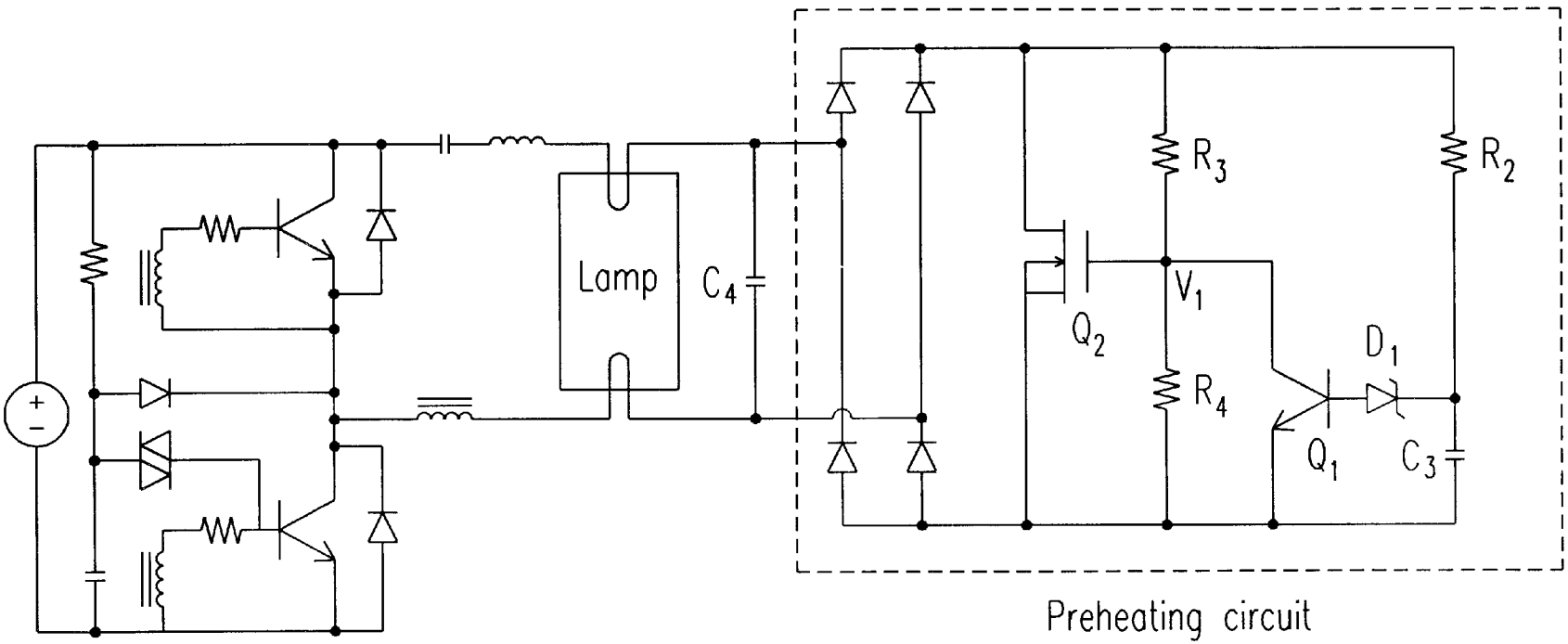
Fig. 1(b)(PRIOR ART)
Figure 1C:
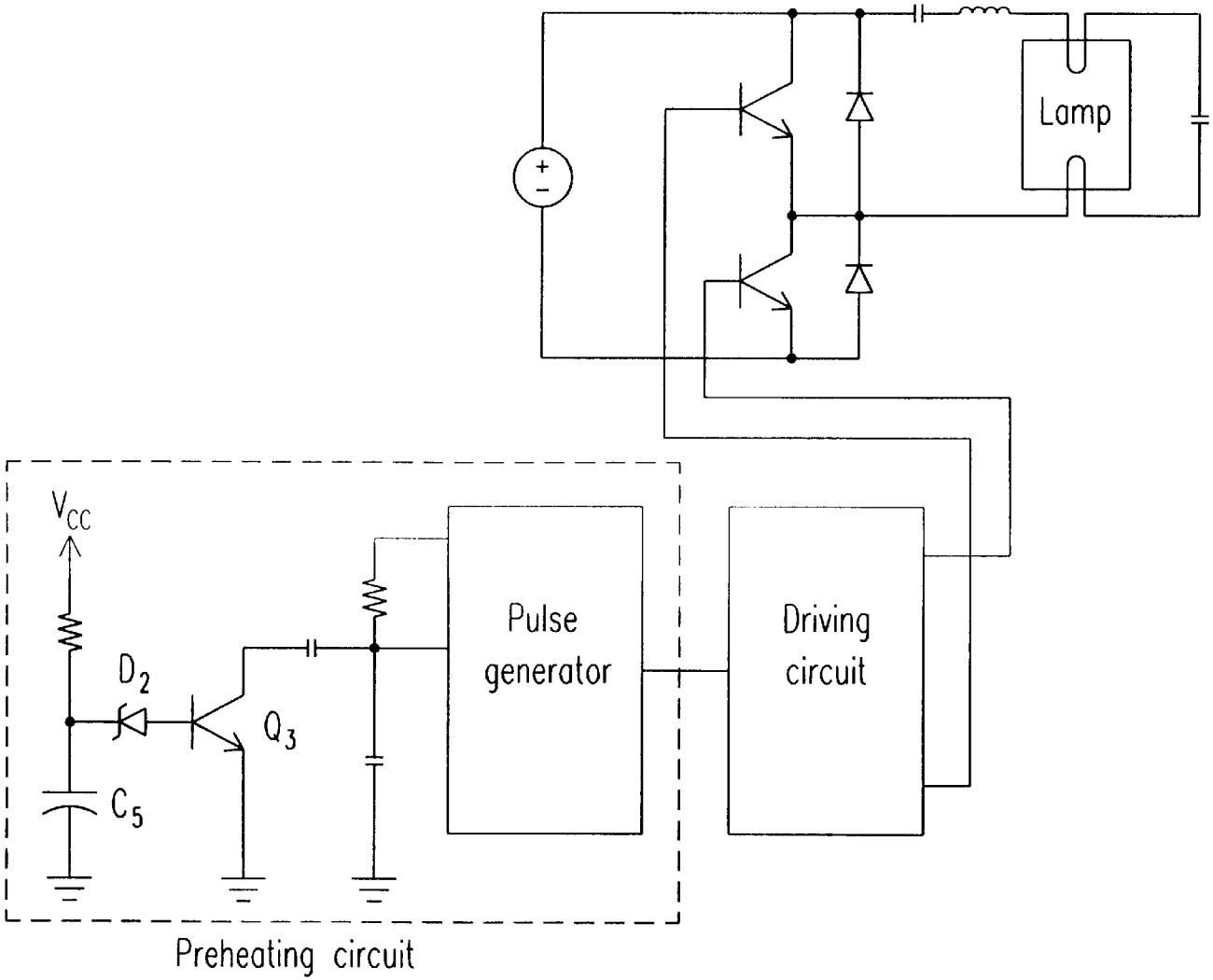
Fig. 1(c)(PRIOR ART)
Figure 2:
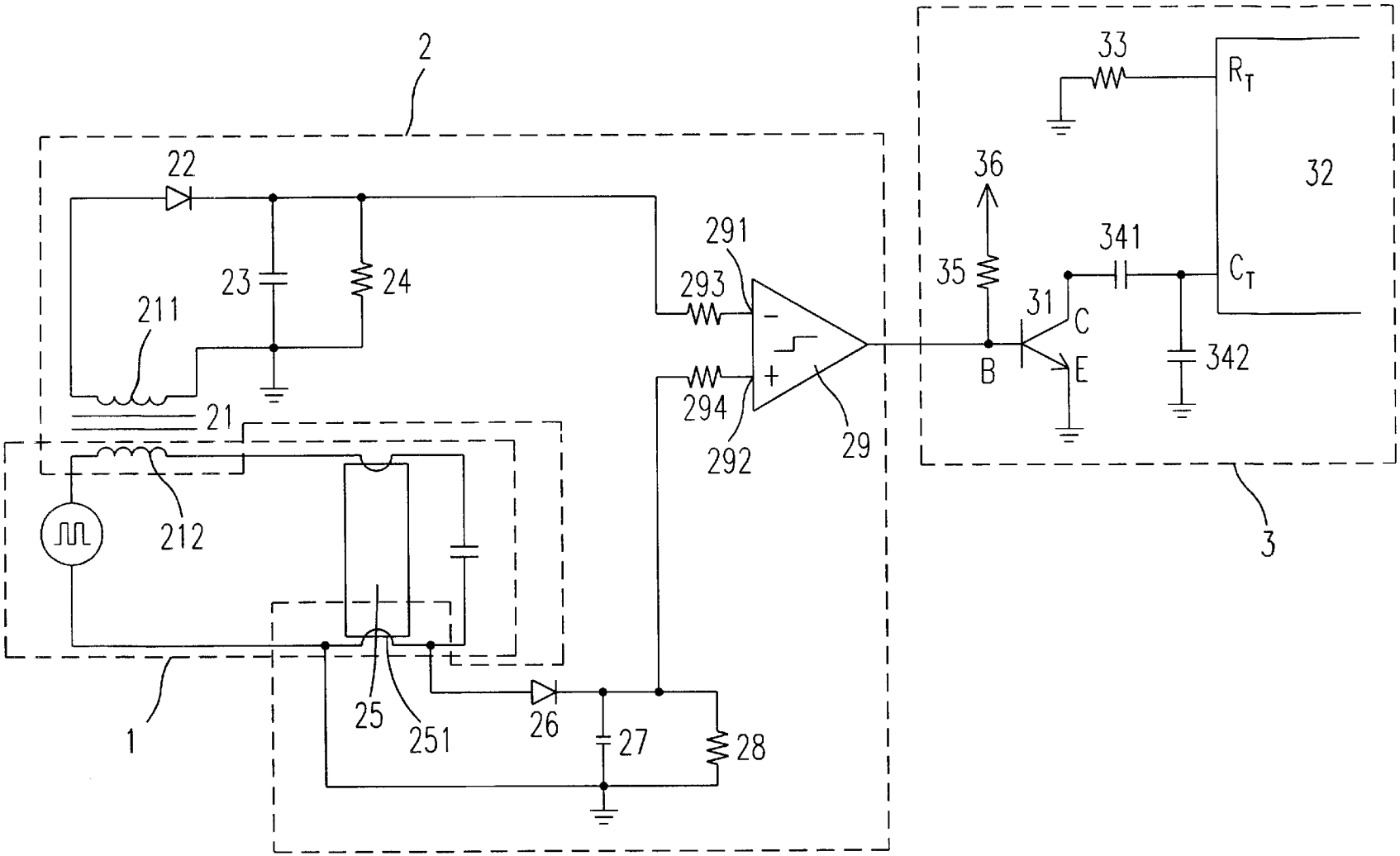
FIG. 2 is a schematic diagram illustrating a preheating circuit for detecting the filament temperature of a fluorescent lamp according to the first preferred embodiment of the present invention.

FIG. 2 is a schematic diagram illustrating a preheating circuit for detecting the filament temperature of a fluorescent lamp according to the preferred embodiment of the present invention. As shown in FIG. 2, the preheating circuit for a fluorescent lamp includes a filament detecting circuit 2, a pulse generation circuit 3, and a filament resonant circuit 1. The filament detecting circuit 2 indirectly detects a filament resistance $R_f$ in a fluorescent lamp 25 by measuring a filament voltage $V_{R_f}$ and a filament current $I_{R_f}$. The pulse generation circuit 3 provides pulses of one of a first frequency and a second frequency determined by the detected filament resistance $R_f$ and a specific filament resistance. And the filament resonant circuit 1 operates the fluorescent lamp 25 at an operating frequency determined by the pulse generation circuit 3 so that the filament resonant circuit 1 operates at the first frequency to preheat the fluorescent lamp 25 when the detected filament resistance $R_f$ is smaller than the specific resistance. On the other hand, the filament resonant circuit 1 operates at the second frequency to operate the fluorescent lamp 25 when the detected filament resistance $R_f$ is one of a first value being larger than and a second value being equal to that of the specific resistance.

Meanwhile, the first frequency is a preheating frequency $\omega_{s(ph)}$. The second frequency is a switching frequency $\omega_{s(ft)}$ at full load. The specific resistance is a hot filament resistance $R_h$ which is an index to preheat the fluorescent lamp 25 when the detected filament resistance $R_f$ is smaller than the hot filament resistance $R_h$.

However, the hot filament resistance $R_h$ is $\gamma$ times a cold filament resistance $R_c$, where $\gamma$ is a preheating ratio and $\gamma>1$.

The filament detecting circuit 2 includes a first series circuit, a second series circuit, and a comparator 29. The first series circuit including a secondary winding 211 of a transformer 21 and a first diode 22 is electrically connected in parallel to with a first smoothing capacitor 23 and a first resistor 24 for generating a first DC output voltage. The second series circuit of a filament resistor 251 and a second diode 26 is electrically connected in parallel with a second smoothing capacitor 27 and a second resistor 28 for generating a second DC output voltage. And the comparator 29 has an inverting input 291 electrically connected to one end of a third resistor 293 and a noninverting input 292 electrically connected to one end of a fourth resistor 294. The other end of the third resistor 293 is electrically connected to the first smoothing capacitor 23, the first resistor 24, and the first diode 22. The other end of the fourth resistor 294 is electrically connected to the first smoothing capacitor 27, the second resistor 28, and the second diode 26. The output terminal of the comparator 29 is electrically connected to the pulse generation circuit 3 to provide a switching signal to the pulse generation circuit 3.

The pulse generation circuit 3 includes a pulse generator 32, and a switching element. The switching element is a bipolar transistor 31. The output terminal of the comparator 29 is electrically connected to the base of the bipolar transistor 31 and one end of a fifth resistor 35. The other end of the fifth resistor 35 is electrically connected to a voltage source 36. The collector of the bipolar transistor 31 is electrically connected to one end of a first timing capacitor 341. The other end of the first timing capacitor 341 is electrically connected to a timing capacitor terminal $C_T$ of the pulse generator 32 and one end of a second timing capacitor 342. The other end of the second timing capacitor 342 is ground. One end of a sixth resistor 33 is electrically connected to a timing resistor terminal $R_T$ of the pulse generator 32 and the other end of the sixth resistor 33 is ground. The voltage source 36 provides a voltage $V_{CC}$ to turn on the bipolar transistor 31 when the output signal of the comparator 29 is High. On the other hand, the bipolar transistor 31 is turned off when the output signal of the comparator 29 is Low.

The first DC output voltage is in proportion to a secondary voltage $V'_{Lr}$ of the secondary winding 211 of the transformer 21, and the second DC output voltage is in proportion to a filament voltage $V_{R_f}$ across the filament resistor 251 where a turn ratio of the transformer 21 is $\omega_{s(ph)}L_r/\gamma R_c$, and $L_r$ is an inductance of the primary winding 212 of the transformer 21. The secondary voltage $V'_{Lr}$ equals to $\gamma R_c * V_{Lr}/\omega_{s(ph)}L_r$ where $V_{Lr}$ is a primary voltage of the primary winding 212 of the transformer 21. And, the filament voltage $V_{R_f}$ equals to $R_f * V_{Lr}/\omega_{s(ph)}L_r$.

The filament resonant circuit 1 operates at the preheating frequency $\omega_{s(ph)}$ to preheat the fluorescent lamp 25 when the detected filament resistance $R_f$ is smaller than the hot filament resistance $R_h$ while the filament resonant circuit 1 operates at the switching frequency $\omega_{s(ft)}$ to operate the fluorescent lamp 25 when the detected filament resistance $R_f$ is one of a first value being larger than and a second value being equal to that of said hot filament resistance $R_h$. The filament resistance $R_f$ of the filament resistor 251 can be obtained from the filament voltage $V_{R_f}$ so that the filament resonance circuit 1 operates at the preheating frequency $\omega_{s(ph)}$ to preheat the fluorescent lamp 25 when the filament voltage $V_{R_f}$ is smaller than the secondary voltage $V'_{Lr}$. Nevertheless, the filament resonant circuit 1 operates at the switching frequency $\omega_{s(ff)}$ to operate the fluorescent lamp 25 when the filament voltage $V_{Rf}$ is one of a first value being larger than and a second value being equal to that of the secondary voltage $V'_{Lr}$.

Figure 3:
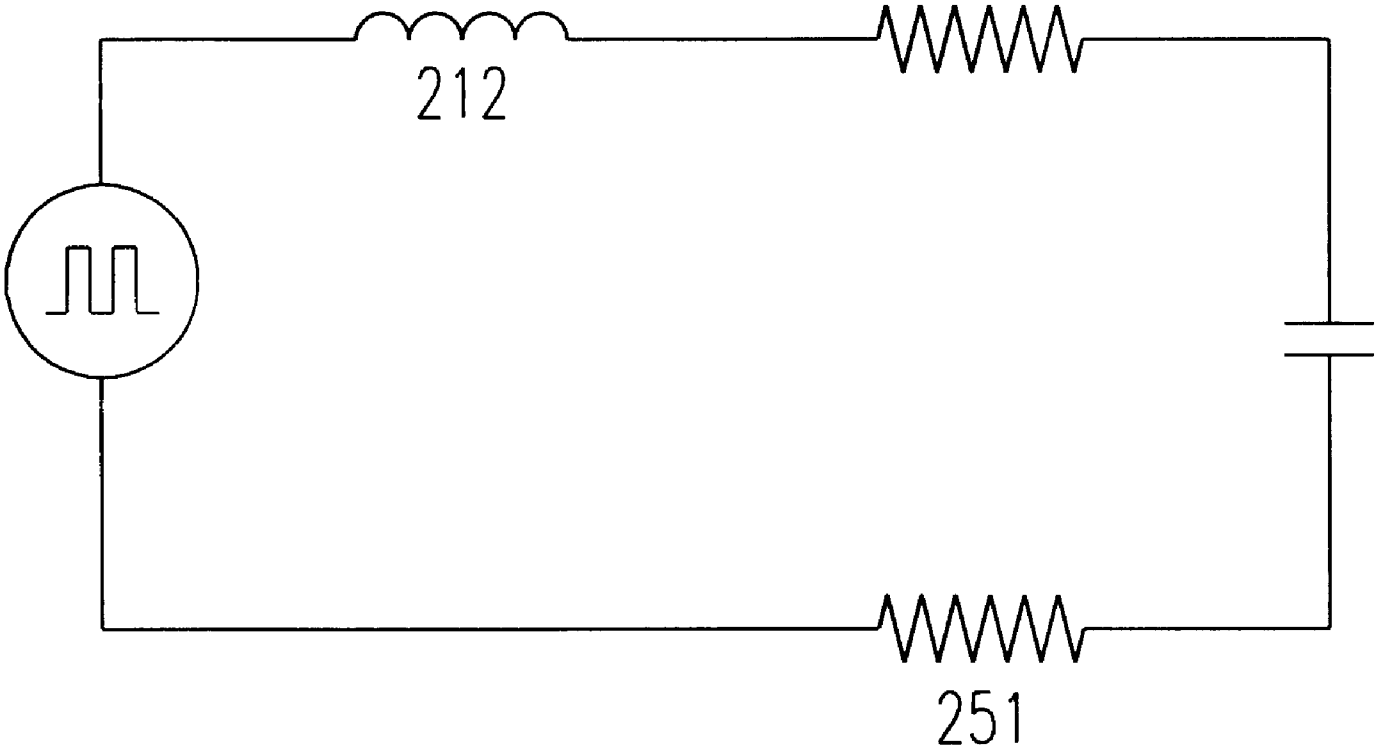
FIG. 3 is a schematic diagram illustrating the equivalent circuit of the resonant circuit according to the present invention.

FIG. 3 is a schematic diagram illustrating the equivalent circuit of the resonant circuit according to the present invention. As shown in FIG. 3, the filament resistance $R_f$ is obtained from the filament voltage $V_{Rf}$ and the filament current $I_{R_f}$ across the filament 25, which is given as follows:

$$R_f = \frac{V_{R_f}}{I_{R_f}}.$$

In practice, sensing voltage is much easier than sensing current. In the present invention, the filament voltage $V_{R_f}$ is measured directly from a voltage across the filament resistor 251, while the filament current $I_{R_f}$ is measured by way of an inductor voltage $V_{Lr}$ across the primary winding 212 of the transformer 21 for the convenience of implementation. The filament current is given as follows:

$$I_{R_f} = \frac{V_{L_r}}{\omega_{s(ph)} L_r}.$$

Thus, $$R_f = \frac{V_{R_f}}{\frac{V_{L_r}}{\omega_{s(ph)} L_r}}.$$

FIG. 2 shows the circuit implementation of detecting $R_h=\gamma R_c$, in which the turns ratio $n=\omega_{s(ph)}L_r/\gamma R_c$ and $\gamma>1$. At the beginning, the filament resistance $R_f=R_c$, so that $V_{Rf}$ equals to $R_cV_{Lr}/\omega_{s(ph)}L_r$. Because $V_{Rf}$ is smaller than $\gamma R_cV_{Lr}/\omega_{s(ph)}L_r$, the output of the comparator 29 is close to ground level. Thus, the switching element is in the off state and the preheating frequency $\omega_{s(ph)}$ is determined by the capacitance of the second timing capacitor 342 and the resistance of the timing resistor 33. When the filament resistance $R_f$ of the filament resistor 251 reaches $R_h=\gamma R_c$, the output of the comparator 29 is pulled to the voltage $V_{cc}$, which turns on the switching element and causes operating frequency changing from the preheating frequency $\omega_{s(ph)}$ to the switching frequency $\omega_{s(ff)}$. This switching frequency $\omega_{s(ff)}$ is determined by the resistance of the timing resistor 33 and the summation of the capacitance of the first timing capacitor 341 and the capacitance of the second timing capacitor 342. When filament resistance reaches $R_h=\gamma R_c$, the lamp 25 is ready to be ignited.

In sum, the preheating circuit of the present invention can ensure that the filament always operates at a proper thermionic emission temperature, which results in reducing sputtering significantly.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A preheating circuit for a fluorescent lamp comprising:

a filament detecting circuit for indirectly detecting a filament resistance in a fluorescent lamp by measuring a filament voltage and a filament current;

a pulse generation circuit for providing pulses of one of a first frequency and a second frequency determined by said detected filament resistance and a specific filament resistance; and a filament resonance circuit for operating said fluorescent lamp, and having an operating frequency determined by said pulse generation circuit so that said filament resonance circuit operates at said first frequency to preheat said fluorescent lamp when said detected filament resistance is smaller than said specific resistance and said filament resonance circuit operates at said second frequency to operate said fluorescent lamp when said detected filament resistance is one of a first value being larger than and a second value being equal to that of said specific resistance.

2. The preheating circuit according to claim 1, wherein said first frequency is a preheating frequency $\omega_{s(ph)}$.

3. The preheating circuit according to claim 2, wherein said second frequency is a switching frequency $\omega_{s(ff)}$ at full load.

4. The preheating circuit according to claim 3, wherein said specific resistance is a hot filament resistance $R_h$ which is an index to preheat said fluorescent lamp when said detected filament resistance $R_f$ is smaller than said hot filament resistance $R_h$.

5. The preheating circuit according to claim 4, wherein said hot filament resistance $R_h$ is $\gamma$ times a cold filament resistance $R_c$ where $\gamma$ is a preheating ratio and $\gamma>1$.

6. The preheating circuit according to claim 5, wherein said filament detecting circuit comprises:

a first series circuit of a secondary winding of a transformer and a first diode electrically connected in parallel to a first smoothing capacitor and a first resistor for generating a first DC output voltage;

a second series circuit of a filament resistor and a second diode connected in parallel to a second smoothing capacitor and a second resistor for generating a second DC output voltage; and a comparator having an inverting input electrically connected in parallel to said first smoothing capacitor, and a noninverting input electrically connected in parallel to said second smoothing capacitor for providing a switching signal to said pulse generation circuit for generating said operating frequency.

7. The preheating circuit according to claim 6, wherein said first DC output voltage is in proportion to a secondary voltage $V'_{Lr}$ of said secondary winding of said transformer and said second DC output voltage is in proportion to a filament voltage $V_{R_f}$ across said filament resistor.

8. The preheating circuit according to claim 7, wherein a turn ratio of said transformer is $\omega_{s(ph)}L_r/\gamma R_c$ where $L_r$ is an inductance of said primary winding of said transformer.

9. The preheating circuit according to claim 8, wherein said secondary voltage $V'_{Lr}$ equals to $\gamma R_c{*}V_{Lr}/\omega_{s(ph)}L_r$ where $V_{Lr}$ is a primary voltage of said primary winding of said transformer.

10. The preheating circuit according to claim 9, wherein said filament voltage $V_{R_f}$ equals to $R_f{*}V_{Lr}/\omega_{s(ph)}L_r$.

11. The preheating circuit according to claim 10, wherein said filament resonance circuit operates at said first frequency to preheat said fluorescent lamp when said detected filament resistance $R_f$ is smaller than said hot filament resistance $R_h$ and said filament resonance circuit operates at said second frequency to operate said fluorescent lamp when said detected filament resistance $R_f$ is one of a first value being larger than and a second value being equal to that of said hot filament resistance $R_h$.

12. The preheating circuit according to claim 9, wherein said filament resonance circuit operates at said first frequency to preheat said fluorescent lamp when said filament voltage $V_{R_f}$ is smaller than said secondary voltage $V'_{Lr}$ and said filament resonance circuit operates at said second frequency to operate said fluorescent lamp when said filament voltage $V_{R_f}$ is one of a first value being larger than and a second value being equal to that of said secondary voltage $V'_{Lr}$.

* * * * *